US008540113B2

(12) United States Patent
Bailey

(10) Patent No.: US 8,540,113 B2
(45) Date of Patent: Sep. 24, 2013

(54) POP AND SLIDE CONTAINER

(75) Inventor: Ryan A. Bailey, Richmond, VA (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 13/488,627

(22) Filed: Jun. 5, 2012

(65) Prior Publication Data

US 2012/0285125 A1 Nov. 15, 2012

Related U.S. Application Data

(63) Continuation of application No. PCT/US2010/059474, filed on Dec. 8, 2010.

(60) Provisional application No. 61/267,493, filed on Dec. 8, 2009.

(51) Int. Cl.
*B65D 43/12* (2006.01)
*B65D 43/16* (2006.01)
*B65D 43/18* (2006.01)

(52) U.S. Cl.
USPC ..... 220/810; 220/811; 220/813; 220/812; 220/345.1; 220/345.2; 220/823; 206/267; 206/557; 206/259; 206/240; 206/242; 221/282; 221/154; 229/129.1; 229/125.12

(58) Field of Classification Search
USPC ..... 220/351, 345.1, 345.2, 345.3, 345.4, 220/810, 811, 812, 813, 260, 345, FOR. 189, 220/331, 224, 817, 818, 820, 823, 824, 315, 220/254.6, 255; 206/557, 240–276, 540, 206/528; 229/129.1, 125.12; 221/282, 154
See application file for complete search history.

(56) References Cited

U.S. PATENT DOCUMENTS

| | | | | |
|---|---|---|---|---|
| 241,083 | A * | 5/1881 | Somers | 220/345.1 |
| 391,145 | A | 10/1888 | Hardin | |
| 1,369,819 | A * | 3/1921 | Krause | 220/282 |
| 1,997,043 | A * | 4/1935 | Clark | 206/246 |
| 2,026,463 | A * | 12/1935 | Driess | 220/282 |

(Continued)

FOREIGN PATENT DOCUMENTS

WO 2009068280 6/2009

OTHER PUBLICATIONS

International Search Report for corresponding International Application No. PCT/US2010/059474.

*Primary Examiner* — Mickey Yu
*Assistant Examiner* — Gideon Weinerth
(74) *Attorney, Agent, or Firm* — Womble Carlyle Sandridge & Rice, LLP

(57) ABSTRACT

Disclosed is a container comprising a lid and a base. The lid has a top surface and a side wall all about the perimeter of the top surface. The side wall has a lip which may be formed from a rolled edge. The base has a bottom surface and a side wall. The side wall further includes a plurality of tapered sections, a plurality of retention bumps, and a plurality of pivot bumps. The lid is adapted to fit over the base such that the rolled edge abuts underneath the retention bumps and pivot bumps securing the lid in place when the container is closed. The rolled edge of the lid pivots about and slides along the pivot bumps when the container is in an open position to create an opening for accessing contents of the container.

15 Claims, 5 Drawing Sheets

(56) References Cited

U.S. PATENT DOCUMENTS

| | | | | | |
|---|---|---|---|---|---|
| 2,083,356 | A | * | 6/1937 | Batdorf | 220/351 |
| 2,093,508 | A | * | 9/1937 | Batdorf | 220/351 |
| 2,219,486 | A | * | 10/1940 | Nyden | 220/283 |
| 2,219,487 | A | * | 10/1940 | Nyden | 206/534.2 |
| 2,295,747 | A | * | 9/1942 | Mills | 220/351 |
| 2,304,898 | A | * | 12/1942 | Dukehart, Jr. | 220/812 |
| 2,399,470 | A | * | 4/1946 | Crane | 206/249 |
| 2,415,357 | A | * | 2/1947 | Kucki | 220/315 |
| 2,492,864 | A | * | 12/1949 | Hermani | 206/540 |
| 2,661,119 | A | | 12/1953 | Spiess, Jr. et al. | |
| 2,806,626 | A | * | 9/1957 | Nyden | 220/283 |
| 2,813,653 | A | * | 11/1957 | Grossman | 220/345.2 |
| 2,867,348 | A | * | 1/1959 | Morrison | 220/812 |
| 2,906,428 | A | * | 9/1959 | Fralick | 220/283 |
| 3,782,584 | A | * | 1/1974 | Swenson et al. | 220/345.3 |
| 4,946,057 | A | * | 8/1990 | Connolly et al. | 220/481 |
| 6,129,237 | A | * | 10/2000 | Miyahara | 220/812 |
| 6,736,261 | B1 | | 5/2004 | Thomas | |
| D510,859 | S | * | 10/2005 | Dixon et al. | D9/424 |
| 7,014,039 | B2 | * | 3/2006 | Henson et al. | 206/267 |
| 7,140,511 | B2 | * | 11/2006 | Baker et al. | 220/813 |
| D534,068 | S | * | 12/2006 | Tanner | D9/424 |
| 7,721,908 | B2 | * | 5/2010 | Cronin et al. | 220/345.4 |
| 7,798,319 | B1 | | 9/2010 | Bried | |
| 7,938,266 | B2 | * | 5/2011 | Cross | 206/540 |
| 8,096,411 | B2 | | 1/2012 | Bailey | |
| 8,251,218 | B2 | * | 8/2012 | Gelardi | 206/540 |
| 2009/0223841 | A1 | * | 9/2009 | Mack, Jr. | 206/242 |
| 2009/0236257 | A1 | | 9/2009 | Cross | |
| 2010/0072206 | A1 | * | 3/2010 | Doyle | 220/345.2 |
| 2010/0084424 | A1 | | 4/2010 | Gelardi | |
| 2010/0133140 | A1 | * | 6/2010 | Bailey et al. | 206/538 |
| 2010/0243510 | A1 | * | 9/2010 | Cross | 206/540 |
| 2011/0000931 | A1 | | 1/2011 | Gelardi | |
| 2013/0037545 | A1 | * | 2/2013 | Valley et al. | 220/345.2 |

* cited by examiner

POP AND SLIDE CONTAINER

CROSS-REFERENCE TO RELATED APPLICATIONS

This application is a continuation of International Application No. PCT/US2010/059474, filed Dec. 8, 2010, which International Application was published by the International Bureau in English on Jun. 16, 2011, and claims priority to U.S. Provisional Patent Application No. 61/267,493, filed Dec. 8, 2009, all of which are incorporated herein by reference in their entirety and for all purposes.

SUMMARY OF THE INVENTION

Disclosed is a container comprising a lid and a base. The lid has a top surface and a side wall all about the perimeter of the top surface. The side wall may terminate in a rolled edge. The base has a bottom surface and a side wall all about the perimeter of the bottom surface. The side wall may further include a plurality of tapered sections, a plurality of retention bumps that protrude out from the side wall, and a plurality of pivot bumps that protrude out from the side wall. The lid is adapted to fit over the base such that the rolled edge abuts underneath the retention bumps and pivot bumps securing the lid in place when the container is closed. The rolled edge of the lid pivots about and slides along the pivot bumps when the container is in an open position to create an opening for accessing contents of the container. The base can further include a finger indent at one end such that a user can apply pressure simultaneously on the base and the lid at the same end of the container to cause the lid to release from the retention bumps positioned substantially at the other end of the container. The pivot bumps protrude out from the side wall of the base further than the retention bumps so as to let the rolled edge of the lid release from the retention bumps but not the pivot bumps.

DETAILED DESCRIPTION OF THE PREFERRED EMBODIMENTS

Embodiments of the invention describe a container comprised of a base and a lid that is adapted to be held and manipulated by one hand. The container is opened and closed using a pop and slide motion with respect to the lid to expose the contents of the base.

Figure 1:
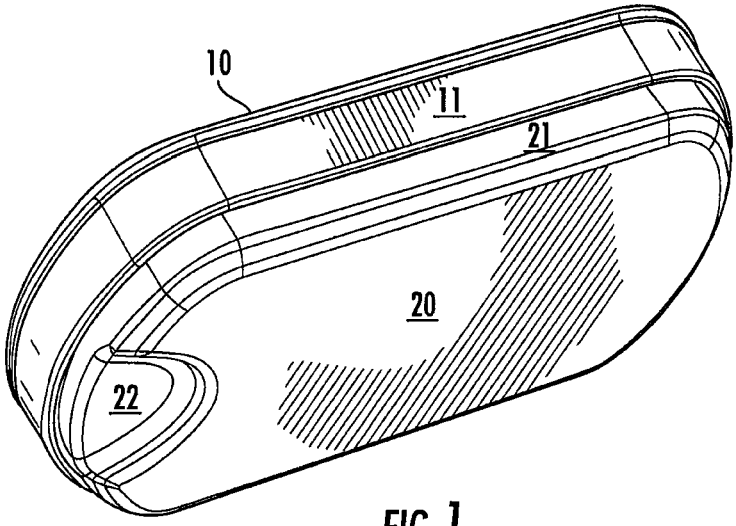
FIG. 1 is a perspective view of a pop and slide container comprised of a lid and a base according to an embodiment of the invention.

FIG. 1 is a perspective view of a pop and slide container in a closed position comprised of a lid 10 and a base 20 according to an embodiment of the invention. The lid 10 and base 20 each comprise a relatively flat surface and side wall 11, 21 that extends the entire perimeter of the surface area giving each component a depth dimension. The base 20 further includes a finger indent 22 area at one end that is adapted to receive a user finger during the opening process. In its closed position, the lid fits atop the base and is held in place through a mechanical coupling of elements of the lid 10 and base 20. These elements are not visible in this figure but will be described further with reference to later figures.

Figure 2:
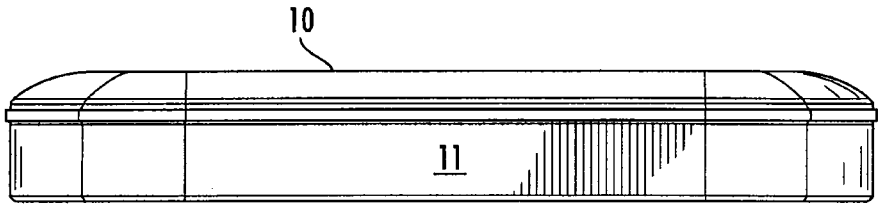
FIG. 2 is a side view of the lid according to an embodiment of the invention.

FIG. 2 is a side view of the lid 10 according to an embodiment of the invention. The surface area referenced earlier comprises the top of lid 10, whereas the side wall 11 about the perimeter of the surface area can be considered the side wall (s) of the container.

Figure 3:
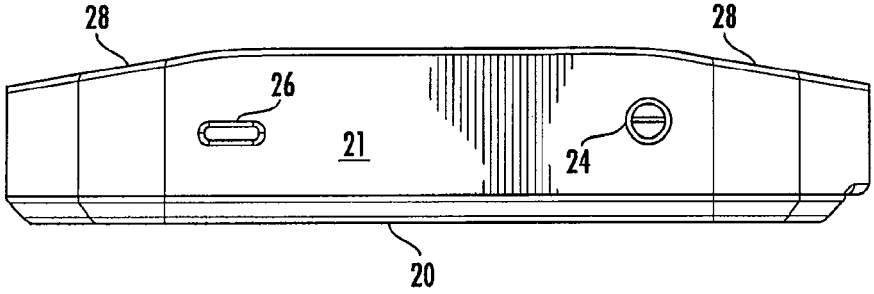
FIG. 3 is a side view of the base according to an embodiment of the invention.

FIG. 3 is a side view of the base 20 according to an embodiment of the invention. The side wall 21 extends upward and away from the base 20 surface area in a substantially perpendicular direction. Also shown are a pair of bumps that protrude outward from the side wall 21. The first bump is referred to as a pivot bump 24 and the second bump is referred to as a retention bump 26. Identical bumps 24, 26 are also present on the side of the base not seen in this figure. The pivot bump 24 and retention bump 26 cooperate with a rolled edge on the side wall 11 of the lid 10 to create a means by which the container can be opened with one hand. Also of note are the tapered sections 28 of the top line of the side wall 21. As will be described in more detail later, the taper closest to the pivot bump 24 is functionally important to the opening and closing of the container.

Figure 4:
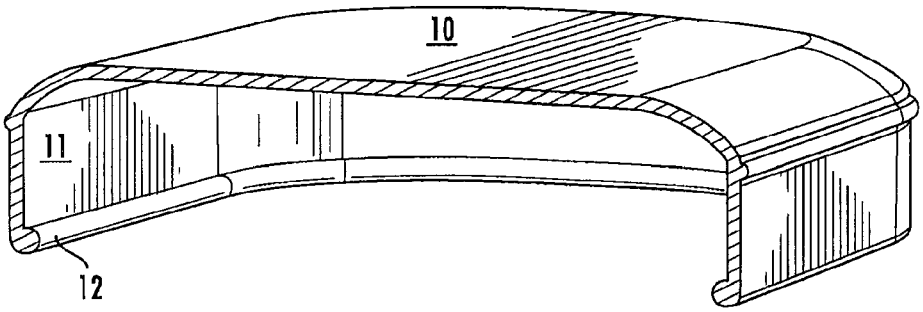
FIG. 4 is a perspective cross-sectional view of the lid according to an embodiment of the invention.

FIG. 4 is a perspective cross-sectional view of the lid 10 according to an embodiment of the invention. This view illustrates how the side wall 11 terminates in a rolled edge 12. The rolled edge 12 creates a lip that can be coupled with the pivot bump 24 and the retention bump 26 of base 20. It is to be understood that the lip could be created using an edge other than the rolled edge. Different materials (plastic, paperboard etc . . . ) may be capable of creating this lip using a different edge structure. It is to be understood that manufacturing preferences may adjust the structure depending upon the material used in the lid and or base.

Figure 5:
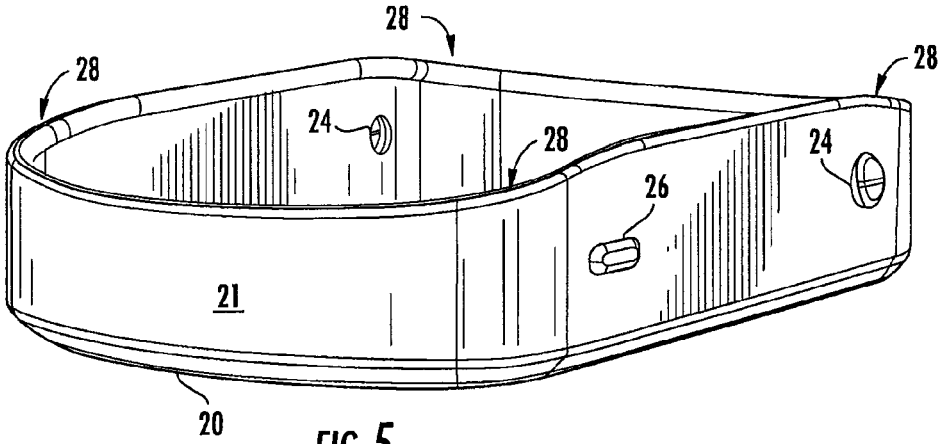
FIG. 5 is a perspective view of the base according to an embodiment of the invention.

FIG. 5 is a perspective view of the base 20 according to an embodiment of the invention. All of the elements and features previously described for base 20 are present. The side wall 21 circumnavigates the perimeter of the surface area of base 20. The tapered sections 28 define high and low points about the side wall 21. The pivot bump 24 and retention bump 26 are also visible. This view further shows that the pivot bump 24 protrudes slightly further out from the side wall 21 than the retention bump 26. As will be described in more detail later, this allows the lip formed by the rolled edge 12 of the lid 10 to release from the retention bump 26 but stay in cooperative contact with the pivot bump 24.

Figure 6:
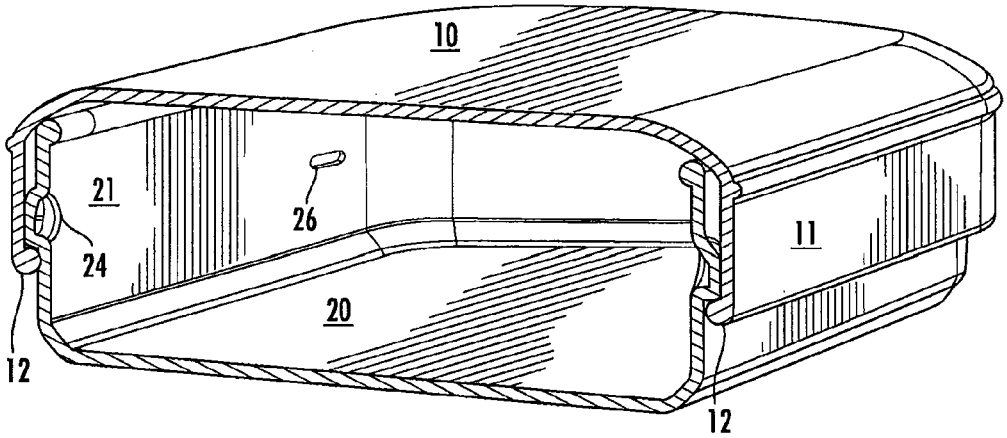
FIG. 6 is a perspective cross-sectional view of the container according to an embodiment of the invention.

FIG. 6 is a perspective cross-sectional view of the container according to an embodiment of the invention. This illustration shows the container in its closed position. The lid 10 fits atop the base 20 such that the lip formed by rolled edge 12 of the lid 10 fits over and is in contact with the pivot bump 24 and retention bump 26 that protrude from side wall 21.

Figure 7:
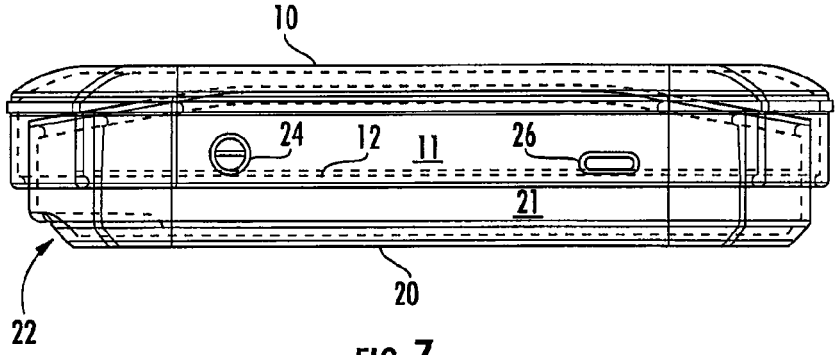
FIG. 7 is a side view of the container in the closed position with hidden lines according to an embodiment of the invention.

FIG. 7 is a side view of the container in the closed position with hidden lines according to an embodiment of the invention. This figure provides a good illustration of the lip formed by the rolled edge 12 in cooperative contact with the pivot bump 24 and the retention bump 26. This cooperative contact on both sides of the container secure the lid 10 to the base 20.

Figure 8:
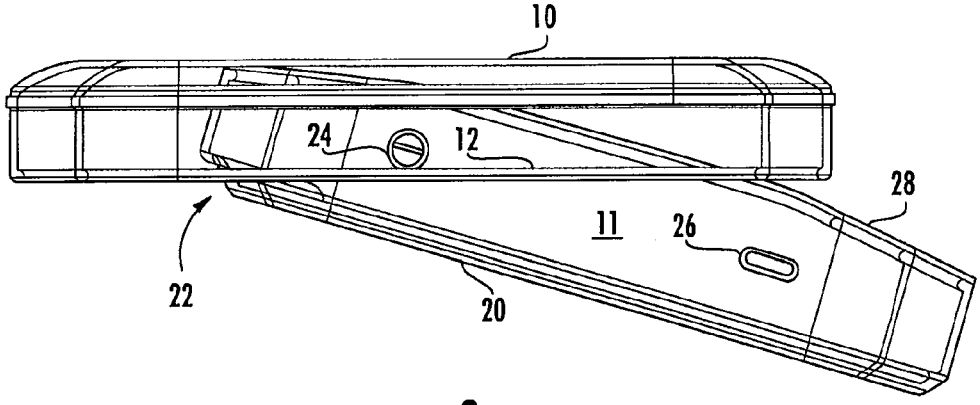
FIG. 8 is a side view of the container in the initial open position with hidden lines according to an embodiment of the invention.

FIG. 8 is a side view of the container in the initial open position with hidden lines according to an embodiment of the invention. This figure illustrates the position of the container immediately following the "pop" motion that a user applies to open the container. The user pinches the end of the container having the finger indent 22. The pinching action causes the rolled edge 12 at the far end of the lid to break free of the retention bump 26 while the lip of the rolled edge 12 remains in contact with the pivot bump 24. The circular geometry of pivot bump 24 allows the lip of the rolled edge to pivot about pivot bump 24.

Figure 9:
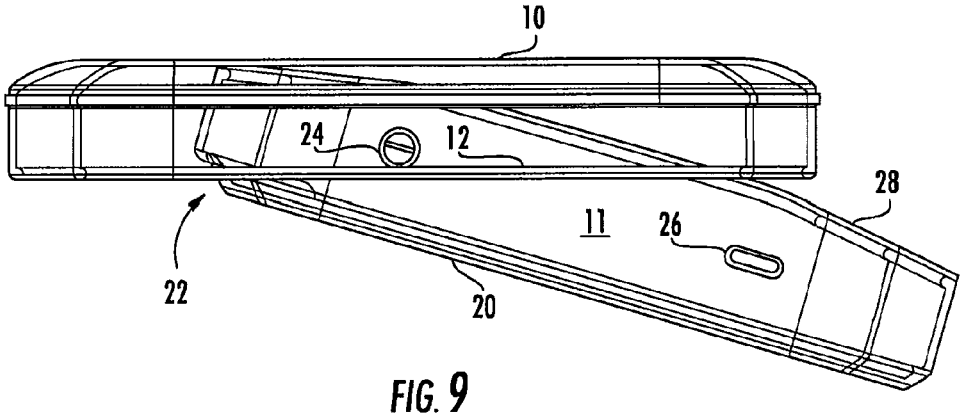
FIG. 9 is a side view of the container in an advanced open position with hidden lines according to an embodiment of the invention.

FIG. 9 is a side view of the container in an advanced open position with hidden lines according to an embodiment of the invention. In this illustration, the lid 10 has been moved back in a sliding motion to provide more access to the base 20. The tapered section 28 provides a degree of clearance for the lid 10 to pivot. The steeper the slope of the tapered section 28, the further the lid 10 can be moved relative to the base 20 to expose more of the open base 20. The lip of the rolled edge 12 remains in contact with the pivot bump 24. The lid 10 can continue to move away from the base 20 until the lip of the rolled edge 12 encounters too much resistance from the base 20 such that further movement will cause the lid to break free of the pivot bump 24.

Figure 10:
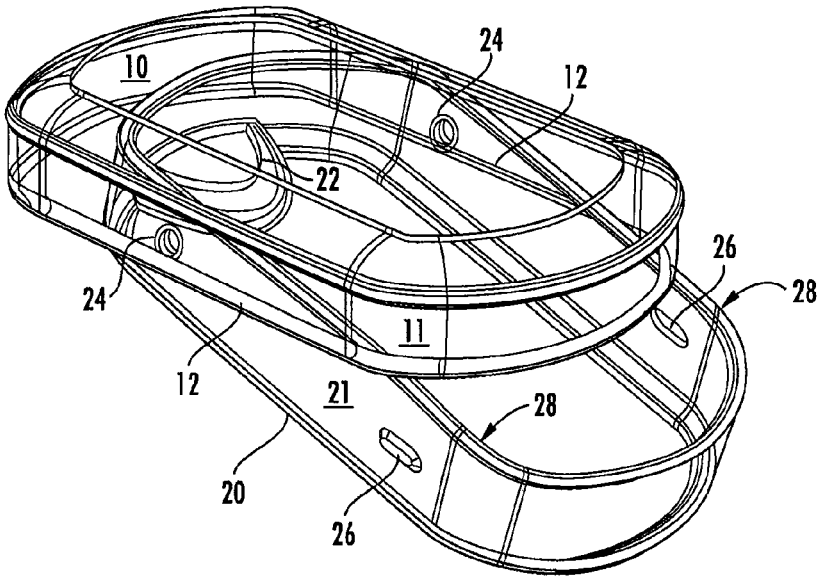
FIG. 10 is a perspective view of the container in an advanced open position with hidden lines according to an embodiment of the invention.

FIG. 10 is a perspective view of the container in an advanced open position with hidden lines according to an embodiment of the invention. This figure is essentially a perspective view of FIG. 9 and further shows the cooperative relationship between the rolled edge 12 and the pivot bumps 24.

In operation, a user will grasp the container in one hand such that a finger or thumb is positioned within finger indent 22. Using a pinching motion, the user presses against the finger indent 22 of base 20 and the top of lid 10. This causes the opposite end of lid 10 to "pop" up after a sufficient force has released the rolled edge 12 from the retention bump 26. The user can then pull the lid 10 back in a sliding motion to partially reveal the base 20. The lip formed by the rolled edge 12 of lid 10 remains in cooperative contact with pivot bump 24 of base 20. The tapered sections 28 of side wall 21 of base 20 allow the lid room to slide and expose a portion of the base 20 such that the user can access the contents of the base 20.

To close the container, the user slides the lid 10 back atop base 20 and presses downward sufficiently to cause the rolled edge to snap over and become secured against retention bump 26 of base 20.

It is to be understood that a variety of materials may be used to make this package, including but not limited to various types of metal, tin, plastic, and paperboard. The lip on the top may be a rolled edge, a divot, an undercut, a ledge or any other structure that would provide a means of retainment.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated embodiments.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container, comprising:

a lid comprising a top wall and a lid side wall, the lid side wall defining an inwardly extending edge; and a base comprising a bottom wall and a base side wall, the base side wall defining: a plurality of pivot bumps that protrude out from the base side wall, the pivot bumps configured to abut the inwardly extending edge of the lid such that the lid would pivot about the pivot bumps and slide thereon between an open position and a closed position;

and a plurality of retention bumps that protrude out from the base side wall, the retention bumps configured to abut the inwardly extending edge of the lid to releasably secure the base to the lid in the closed position.

2. The container of claim 1, wherein the base side wall thither comprises a tapered section configured to define a clearance between the top wall of the lid and the base side wall in the closed position and configured to engage the top wall of the lid in the open position.

3. The container of claim 2. wherein the pivot bumps are positioned between the tapered section and the retention bumps.

4. The container of claim 2, wherein the tapered section is positioned at an end of the base closest to the pivot bumps.

5. The container of claim 2, wherein the base side wall further comprises a second tapered section configured to define a clearance between the lid side wall and the base side wall as the lid pivots between the closed position and the open position.

6. The container of claim 5, wherein the pivot bumps and the retention bumps are positioned between the tapered section and the second tapered section.

7. The container of claim 1, wherein the base defines an indentation positioned at an opposing end of the base relative to the retention bumps, the indentation configured to facilitate application of a compressive force between the lid and the base to release the retention bumps from the inwardly extending edge.

8. The container of claim 7, wherein the pivot bumps are positioned between the indentation and the retention bumps.

9. The container of claim 1, wherein the pivot bumps are rounded.

10. The container of claim 1, wherein the lid and the base are formed from a material selected from a. group consisting of metal, plastic, and paperboard.

11. The container of claim 1, wherein the pivot bumps protrude outwardly from the base side wall further than the retention bumps.

12. the container of claim 1, wherein the lid side wall and the base side wall respectively extend around an entire perimeter of the top surface and the bottom surface.

13. The container of claim 1, wherein the base side wall extends in a substantially perpendicular direction from the bottom surface.

14. The container of claim 1, wherein the inwardly extending edge is configured to remain in contact with the pivot bumps in the closed position and the open position.

15. A process for opening a container with one hand, comprising:

grasping the container of claim 1 in one hand;

applying a pinching motion to one end of the container, which causes the inwardly extending edge of the lid to break free of the retention bumps while the inwardly extending edge remains in contact with the pivot bumps and pivots about the pivot bumps; and pulling the lid back in a sliding motion to partially reveal the base while the inwardly extending edge of the lid remains in cooperative contact with the pivot bumps.

* * * * *

UNITED STATES PATENT AND TRADEMARK OFFICE

CERTIFICATE OF CORRECTION

PATENT NO. : 8,540,113 B2
APPLICATION NO. : 13/488627
DATED : September 24, 2013
INVENTOR(S) : Ryan A. Bailey It is certified that error appears in the above-identified patent and that said Letters Patent is hereby corrected as shown below:

In the Claims

In Claim 2, column 4, line 26, please change [[thither]] to further.

In Claim 12, column 4, line 59, please change [[the]] to The.

Signed and Sealed this
Fifth Day of August, 2014

Michelle K. Lee

Michelle K. Lee
*Deputy Director of the United States Patent and Trademark Office*